US012442140B2

(12) United States Patent
Wollanek et al.

(10) Patent No.: US 12,442,140 B2
(45) Date of Patent: Oct. 14, 2025

(54) TRACK MAINTENANCE MACHINE AND METHOD FOR TAMPING A TRACK

(71) Applicant: Plasser & Theurer Export von Bahnbaumaschinen Gesellschaft m.b.H., Vienna (AT)

(72) Inventors: Samuel Wollanek, Pregarten (AT); Johannes Max-Theurer, Vienna (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 971 days.

(21) Appl. No.: 17/605,091

(22) PCT Filed: Apr. 23, 2020

(86) PCT No.: PCT/EP2020/061271

§ 371 (c)(1),
(2) Date: Oct. 20, 2021

(87) PCT Pub. No.: WO2020/233934

PCT Pub. Date: Nov. 26, 2020

(65) Prior Publication Data

US 2022/0186444 A1 Jun. 16, 2022

(30) Foreign Application Priority Data

May 23, 2019 (AT) ..... A 194/2019

(51) Int. Cl.
*E01B 27/17* (2006.01)

(52) U.S. Cl.
CPC ..... *E01B 27/17* (2013.01); *E01B 2203/10* (2013.01); *E01B 2203/16* (2013.01)

(58) Field of Classification Search
CPC ..... E01B 27/12; E01B 27/13; E01B 27/16; E01B 2203/10; E01B 2203/12; E01B 2203/16

(Continued)

(56) References Cited

U.S. PATENT DOCUMENTS 9,518,845 B2 12/2016 Lichtberger
11,566,383 B2 1/2023 Wollanek et al.

(Continued)

FOREIGN PATENT DOCUMENTS

AT 321347 B 3/1975
AT 359110 B 10/1980

(Continued)

OTHER PUBLICATIONS

Chinese Office Action in Chinese Application No. 202080037641.8 dated Dec. 23, 2023 with English translation.

(Continued)

*Primary Examiner* — S. Joseph Morano
*Assistant Examiner* — Heaven R Buffington
(74) *Attorney, Agent, or Firm* — Collard & Roe, P.C.

(57) ABSTRACT

The invention concerns a track maintenance machine for tamping a track having sleepers supported in a ballast bed with rails fitted to the same, with a machine frame that is mobile on on-track undercarriages and with a tamping unit. Wherein a camera for transmitting real-time images to an output means is arranged upstream of the tamping unit in a working direction. A first camera system is arranged upstream of the tamping unit in working direction here for recording a first surface area of the track as a first image section. In addition, a second camera system is arranged downstream of the tamping unit in working direction for recording a second surface area of the track as a second image section, wherein the recorded image sections partly overlap and wherein the output means is equipped for issuing the image sections in a merged image.

15 Claims, 3 Drawing Sheets

(58) Field of Classification Search
USPC ..... 104/10, 12
See application file for complete search history.

(56) References Cited

U.S. PATENT DOCUMENTS

| | | | |
|---|---|---|---|
| 2002/0078853 | A1 | 6/2002 | Holmes et al. |
| 2017/0029001 | A1 | 2/2017 | Berggren |
| 2017/0096783 | A1 | 4/2017 | Petersen |
| 2020/0115859 | A1 | 4/2020 | Buerger |

FOREIGN PATENT DOCUMENTS

| | | | | | |
|---|---|---|---|---|---|
| AT | 13635 | U1 | | 5/2014 | |
| AT | 519739 | B1 | | 10/2018 | |
| CN | 2340801 | Y | * | 9/1999 | |
| CN | 201794010 | U | * | 4/2011 | |
| CN | 105220589 | A | | 1/2016 | |
| CN | 108195472 | A | | 6/2018 | |
| CN | 109477313 | A | | 3/2019 | |
| JP | H02-101204 | A | | 4/1990 | |
| JP | H05-328054 | A | | 12/1993 | |
| JP | H06-322707 | B2 | | 11/1994 | |
| JP | 2004-301619 | A | | 10/2004 | |
| JP | 2018-197058 | A | | 12/2018 | |
| WO | WO-2006004846 | A2 | * | 1/2006 | ..... B61K 9/00 |
| WO | WO-2018206214 | A1 | * | 11/2018 | ..... B61L 23/04 |

OTHER PUBLICATIONS

International Search Report of PCT/EP2020/061271, mailed Jun. 23, 2020.
Indian Office Action in Indian Application No. 202127044396 dated Apr. 27, 2023.

* cited by examiner

TRACK MAINTENANCE MACHINE AND METHOD FOR TAMPING A TRACK

CROSS REFERENCE TO RELATED APPLICATIONS

This application is the National Stage of PCT/EP2020/061271 filed on Apr. 23, 2020, which claims priority under 35 U.S.C. § 119 of Austrian Application No. A 194/2019, filed on May 23, 2019, the disclosure of which is incorporated by reference. The international application under PCT article 21(2) was not published in English.

FIELD OF TECHNOLOGY

The invention concerns a track maintenance machine for tamping a track having sleepers supported in a ballast bed with rails fitted to the same, with a machine frame that is mobile on on-track undercarriages and with a tamping unit which comprises tamping tools to be lowered into the ballast bed and set to vibrate and to be squeezed towards one another, wherein a camera for transmitting real-time images to an output means is arranged upstream of the tamping unit in a working direction. The invention further concerns a method for operating the track maintenance machine.

PRIOR ART

A generic track maintenance machine equipped with an assistance system for a remote-controllable completion of tamping processes is known from WO 2018/206214 A1. A camera is directed at working units of the machine here for transmitting real-time images to a display device in a driver's cab. This omits the requirement of arranging a separate working cabin with a view onto the working unit. The image section of the camera mostly corresponds to the field of vision of an operator in such a working cabin.

ILLUSTRATION OF THE INVENTION

The invention is based on the object of improving the real-time images for remotely controlling the tamping unit of a track maintenance machine of the type mentioned above. An improved method for operating a corresponding track maintenance machine is also to be provided.

According to the invention, these objects are achieved by the features of claims 1 and 9. Advantageous further developments of the invention result from the dependent claims.

A first camera system is arranged in working direction upstream of the tamping unit here for recording a first surface area of the track as a first image section, whilst a second camera system is arranged in working direction downstream of the tamping unit for recording a second surface area of the track as a second image section, wherein the recorded image sections partly overlap and wherein the output means is equipped for issuing the image sections in a merged image. The arrangement of such a video system provides an operator with unobstructed real-time images of the track located below the tamping unit. The areas of the track hidden by the components of the tamping unit in the image section of the front camera system are recorded on the image section of the rear camera system. Vice versa the front camera system records areas hidden from the rear camera system. Via the geometric relations of the fastening points and the alignment of the camera systems and the tamping unit, the position of the tamping unit is also known in the merged image. The output means therefore supplies the operator with a comprehensive illustration of the current track area to be tamped in relation to the actual position of the tamping unit. With this real-time information, the tamping unit can be positioned remotely above a respective sleeper in an efficient way and a tamping cycle can be carried out.

One further development of this solution envisages that the tamping unit is arranged for displacement relative to the camera system by means of displacement drives, and that the output means is equipped for displaying a current position of the tamping unit. For this, displacement paths of the displacement drives are for example continuously registered and evaluated. This for example concerns the displacements of the tamping unit in working direction or transverse to the same as well as rotations of the tamping unit around a vertical axis.

In one advantageous embodiment of the invention, the camera systems have diagonally downward directed camera axes, wherein a computer unit is set up for rectifying the distortion of the recorded image sections. The diagonal camera axes allow the recording of larger image sections without hidden areas. The distortion correction carried out effects that a top view of a realistic overall illustration of the track results in the merged image.

A further improvement envisages that each camera system comprises at least two cameras arranged next to each other in a transverse machine direction for recording part image sections, that the part image sections of the two cameras arranged next to each other overlap, and that the output means is equipped for merging all part image sections. With this arrangement, additional image content without hidden areas is available, which increases the information content of the merged image. Camera lenses with longer focal lengths can also be used, which reduces the effort for avoiding distortion errors.

In one further development of the invention, a lighting means with downwardly directed light beams for generating a light marking, in particular in the form of a lighting pattern, is arranged in the recorded surface areas of the track. This light marking is visible in the merged image and provides the operator with additional position information.

In order to avoid a negative influencing of the recording quality through direct sun radiation, it makes sense if the camera systems are equipped for recording infrared light and if at least one infrared light source is arranged for illuminating the surface areas of the track to be recorded. An infrared light source is also used for a possibly generated light marking.

One advantageous extension envisages that a sensor means for recording sleeper positions is arranged in working direction upstream of the first camera system. Such a sensor system offers the operator additional support when remote controlling the tamping unit.

It is favourable here if the output means is coupled with the sensor means for displaying the recorded sleeper positions in the merged image. The illustrated sleepers are for example delimited with a digital marking. This increases safety when positioning the tamping unit.

Advantageously, at least one camera is additionally arranged laterally next to the tamping unit for recording a current vertical position of the tamping tools. In this way a penetration depth of the tamping tools into the ballast bed can also be controlled remotely.

With the method according to the invention for operating the track maintenance machine, an operator is shown the merged image in real time with the aid of the output means, wherein the tamping unit is positioned relative to the track using the merged image. The illustration of the track in a top view allows the tamping tools to be positioned above a respective sleeper crib in a simple way.

In one advantageous further development of the method, a current position of the tamping unit is recorded, wherein the penetration points of the tamping tools resulting from this are displayed in the merged image. Current positions of tamping tines arranged at lower tamping tool ends are favourably calculated by means of sensors and a computer unit in relation to the track and displayed in the merged image. This is sensible in particular for displaceable or rotatable tamping units as well as during use of pivotable tamping tines. The operator is therefore shown in real time at which points the tamping tines would penetrate into the ballast bed during a lowering process.

A further improvement of the method envisages that a light marking is generated on the recorded surface areas of the track with the aid of a lighting means. The current position of the tamping unit can for example be displayed with such a marking.

It is also favourable if a lighting pattern is generated with the aid of the lighting means and if the image sections are merged by matching the lighting pattern. In this way a simple merging (stitching) of the image sections can be carried out.

An advantageous method extension, where a three-dimensional illustration of the recorded surface areas of the track is calculated from recorded image data of the camera systems, offers further possibilities. With this, a three-dimensional real-time model of the track with depth information of the ballast bed, the sleepers and the rails, can be illustrated with the aid of the output means.

The positioning of the tamping unit above a sleeper is made easier if sleeper positions are recorded during a forward movement of the track maintenance machine with the aid of a sensor means and if the sleeper positions are displayed to the operator in the merged image. With this enrichment of real-time information a safe operation is possible even under poor light conditions. The sleepers are for example marked with a coloured frame in the illustration.

An additional load is taken off the operator if tamping positions are pre-determined by means of an assistance system and if the suggested tamping positions are displayed to the operator in the merged image. The positioning of the tamping unit is then realised in that the current positions of the tamping tools are brought into alignment with the suggested tamping positions.

BRIEF DESCRIPTION OF THE DRAWINGS

The invention will be described below by way of an example with reference to the enclosed Figures. The following are shown in a schematic illustration.

DESCRIPTION OF THE EMBODIMENTS

Figure 1:
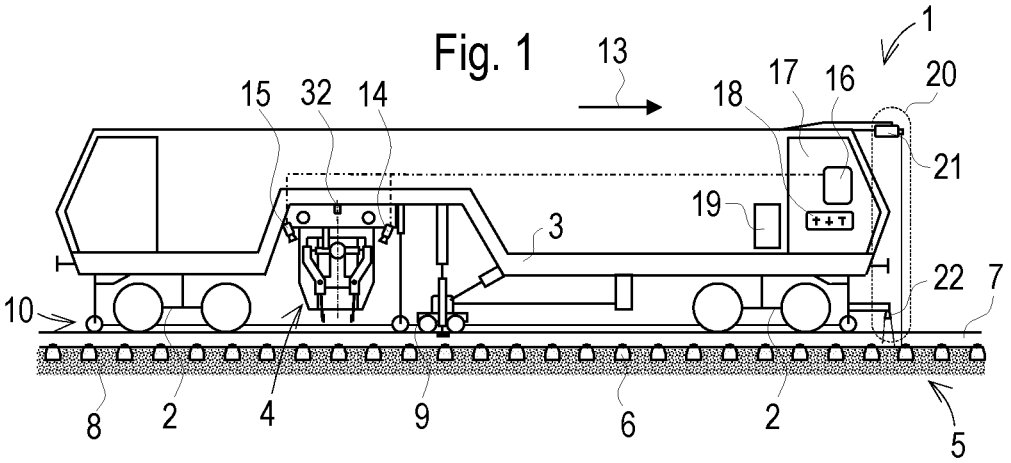
FIG. 1 Track maintenance machine

The track maintenance machine 1 illustrated in FIG. 1 is a tamping machine and comprises a machine frame 3 that is mobile on on-track undercarriages 2. A tamping unit 4 is arranged on the machine frame 3. The tamping machine serves for processing a track 5, where rails 7 fitted onto sleepers 6 are supported in a ballast bed 8. The track maintenance machine 1 can also have additional functions. The machine 1 for example comprises a cleaning device for ballast cleaning or a stabilisation unit for track stabilisation.

During a tamping process, the track panel formed from sleepers 6 and rails 7 is lifted into a target position and possibly displaced laterally by means of a lifting/lining unit 9 and a measuring system 10. For fixing this position, vibrating tamping tools 11 with tamping tines 12 arranged at their lower ends are submersed into the ballast bed 8. The submersed tamping tines 12 are squeezed towards each other and compress the ballast under the lifted sleepers 6 in this way.

A first camera system 14 is arranged upstream of the tamping unit 4 in a working direction 13, and a second camera system 15 downstream of the tamping unit 4. The camera systems 14, 15 are coupled with an output means 16 housed in a cabin 17 of the track maintenance machine 1. An operating means 18 with operating elements for remote controlling the tamping unit 4 is also set up in this cabin 17. In particular, various drives of the units 4, 9 and a travel drive of the track maintenance machine 1 can be operated via a machine controller 19.

A sensor means 20 for recording sleeper positions is optionally arranged upstream of the first camera system 14 in working direction 13. This sensor means 20 for example comprises a rotation laser scanner 21 for recording surface contours and eddy current sensors 22 for detecting rail fastenings. The position of a respective sleeper 6 can be recorded precisely by merging the sensor signals.

Figure 2:
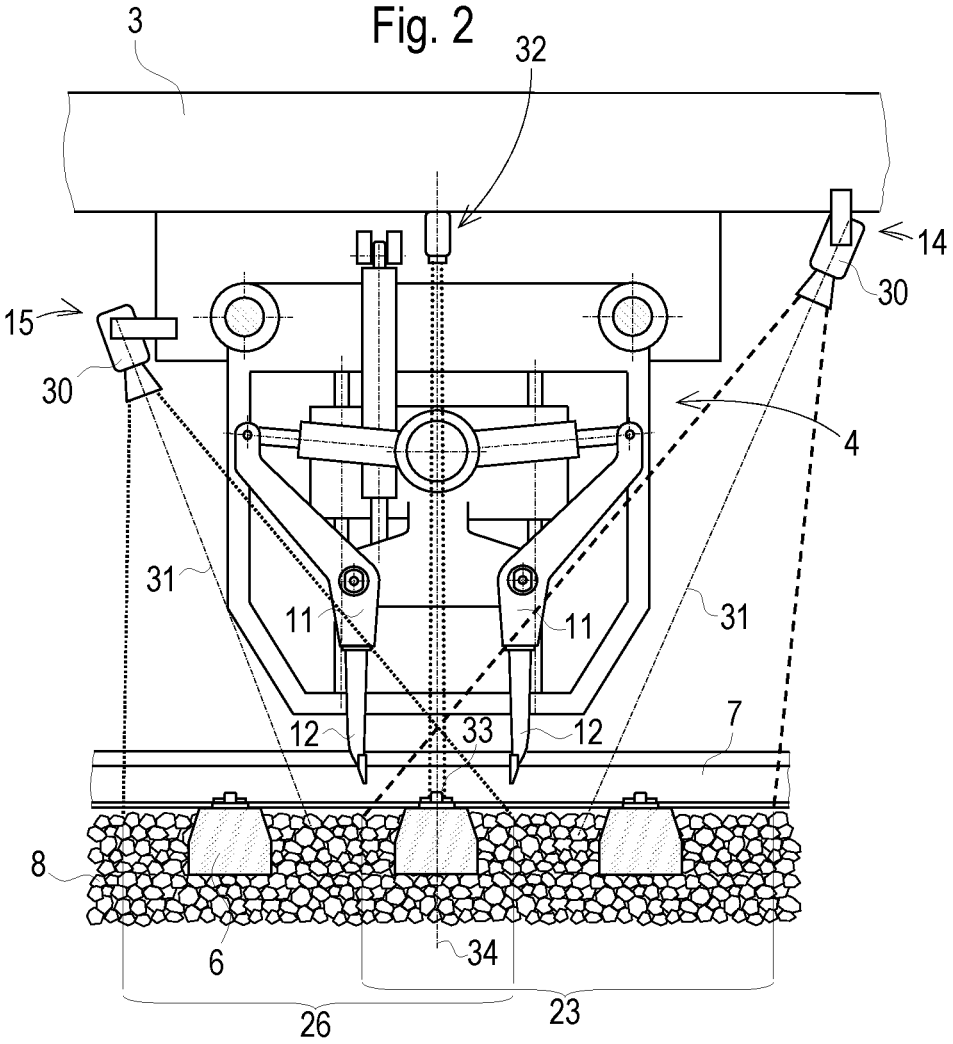
FIG. 2 Tamping unit and camera systems above a track in a side view
Figure 3:
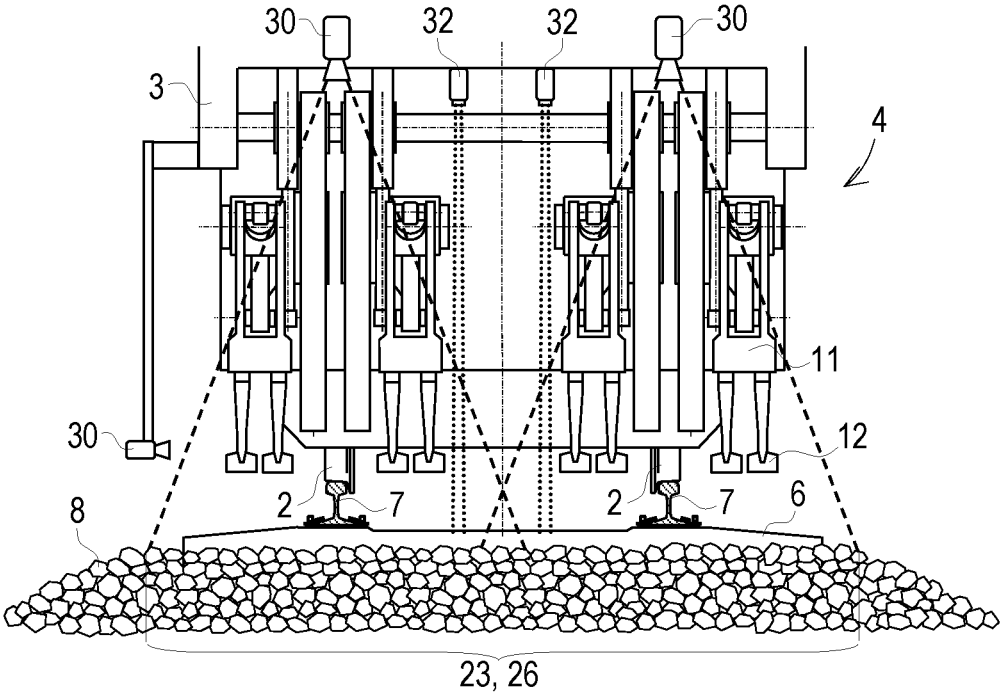
FIG. 3 Arrangement according to FIG. 2 with a cross-section through the track FIG. 4 Top view onto the track with recorded surface areas FIG. 5 Output means FIG. 6 Multi-sleeper tamping unit in a side view
Figure 4:
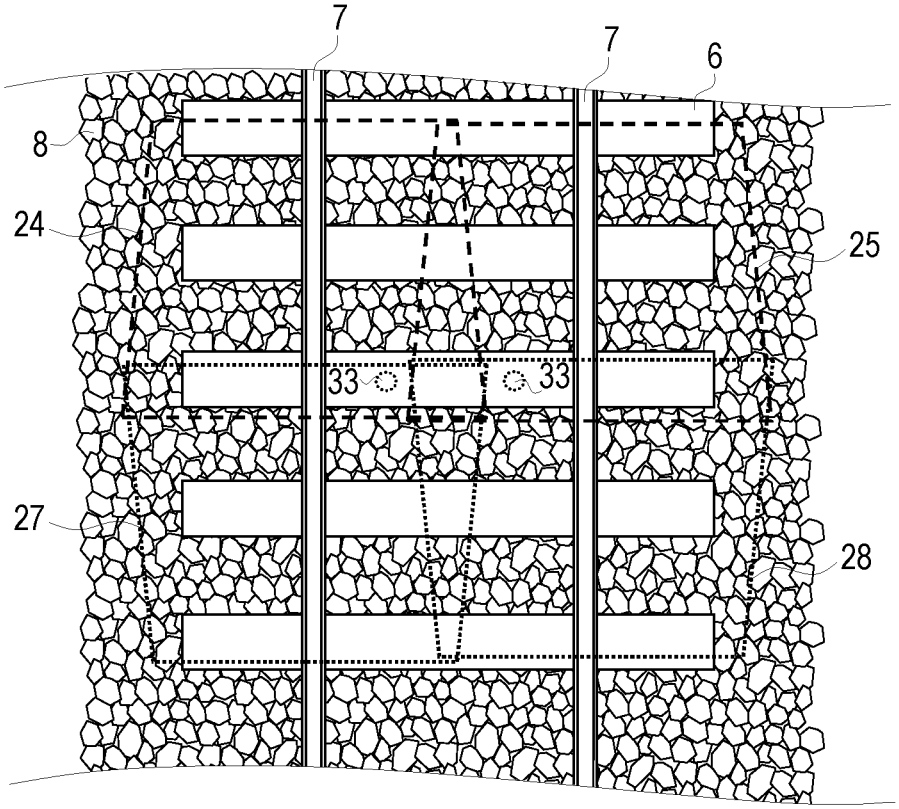

An example of an arrangement of the camera systems 14, 15 is illustrated in FIGS. 2 and 3. A first surface area 23 of the track 5 is recorded as a first image section 24, 25 with the first camera system 14 (FIG. 4). The second camera system 15 records a second surface area 26 of the track 5 as a second image section 27, 28. It is important here that the image sections 24, 25, 27, 28 partly overlap, so that they show the same image content in parts.

In the output means 16, the image sections 24, 25, 27, 28 are merged into an image 29 of the track 5 located under the tamping unit 4. Such a merger of image sections 24, 25, 27, 28 into one complete image 29 is also called stitching. As this is an output of real-time recordings, it enables an operator to control the tamping unit 4 on the basis of the merged image 29. A sufficiently high frame rate is stipulated here for recording the dynamics of the tamping process.

Figure 5:
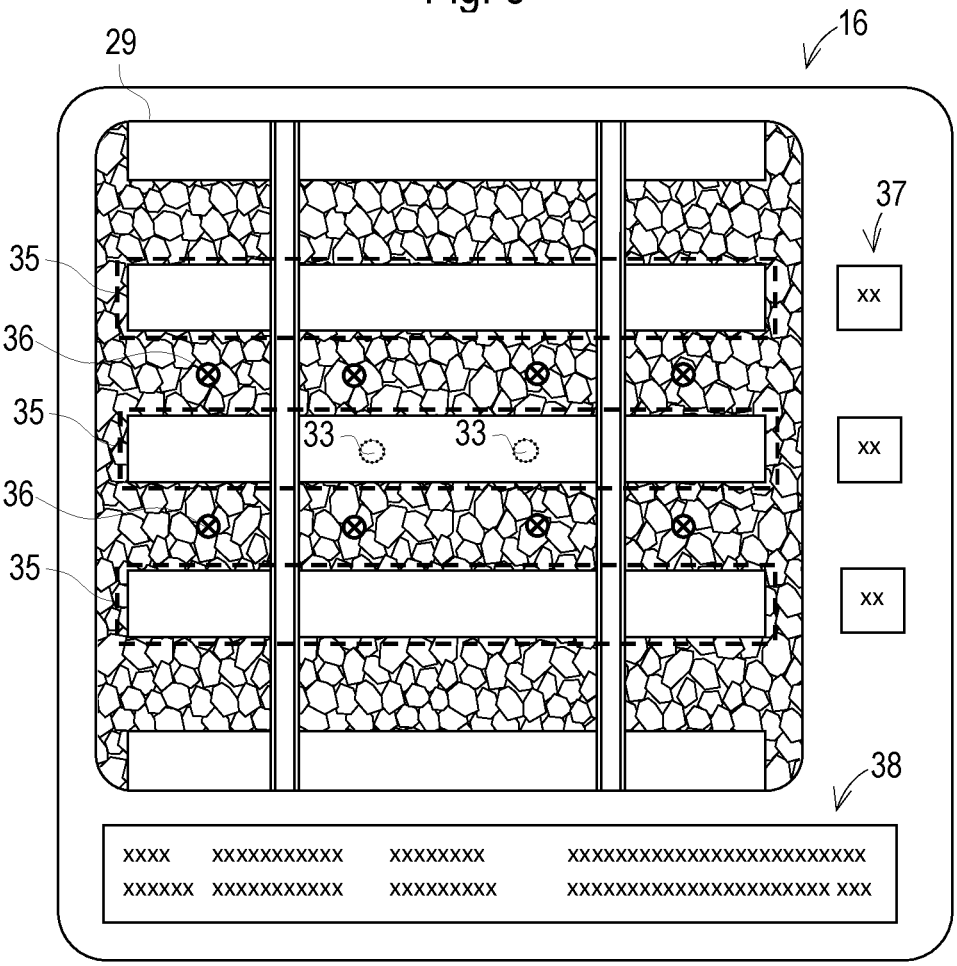

FIG. 5 shows the merged image 29 of the image sections 24, 25, 27, 28 illustrated in FIG. 4 in a monitor window of the output means 16. Two part image sections 24, 25 or 27, 28 each are allocated to the respective surface area 24, 26. As can be seen in FIG. 3, the respective camera system 14, 15 for recording the part image sections 24, 25 or 27, 28 comprises two cameras 30 arranged next to each other in transverse machine direction. The part image sections 24, 25 or 27, 28 of the respective camera system 14, 15 overlap for a loss-free stitching.

It is favourable for minimising the track 5 being hidden by components of the tamping unit 4 if the cameras 30 have camera axes 31 aligned diagonally downwards (FIG. 2). The distortion of image sections 24, 25, 27, 28 that goes hand in hand with this is rectified by means of a computer unit. Each camera or each camera system 14, 15 for example comprises its own computer unit for this. A common computer unit in the output means 16 can also be used to rectify distortion in the image sections 24, 25, 27, 28.

Video cameras 30 with HD resolution and high depth definition are for example used. Video data are processed in real time and displayed in the output means 16 as a merged image 29. With an efficient compression of the video data these can be stored without much effort for documenting the work processes.

Remote controlling the tamping unit 4 is made easier if a lighting means 32 is arranged, which generates light markings 33 within the recorded surface areas 23, 26 by downwardly directed light beams. It is of advantage here if the light markings 33 result in a lighting pattern. The light beams of the lighting means 32 are advantageously aligned along an axis of symmetry 34 of the tamping unit 4. In this way it is additionally shown to the operator when the axis of symmetry 34 is located above a sleeper 6. The light markings 33 can also be used for stitching the image sections 24, 25, 27, 28. So-called parallel beam LEDs can for example be used as lighting bodies of the lighting means 32.

If a sensor means 20 is provided the detected sleeper positions are also known. The position of the tamping unit 4 relative to the detected sleepers 6 results from the known geometric relationship between the arrangement of the sensor means 20 and the arrangement of the tamping unit 4 on the machine frame 3. A coupling with the output means 16 enables the display of the positions of the sleepers 6 in the merged image 29 with markings 35. In this way the operator then also recognises the current position of the tamping unit 4 relative to the sleepers 6 if these are partly covered by ballast.

The demands placed on the operator are reduced further if the output means 16 is coupled with an assistance system for stipulating tamping positions in order to display the suggested tamping positions in merged image 29. Obstacles in the track are for example detected with the aid of the sensor means 20 and the assistance system suggests correspondingly adjusted tamping positions to the operator. In any case, it is of advantage if the penetration points 36 of the tamping tines 12 into the ballast bed 8 currently resulting from the position of the tamping unit 4 are displayed in the merged image 29. These displayed penetration points 36 are then brought into alignment with suggested tamping positions if necessary.

The output means 16 is expediently equipped for displaying additional information. As is clear from FIG. 5, track data 37 are for example displayed next to the sleepers 6. In a further window, condition data 38 of the tamping unit 4 or other devices of the track maintenance machine 1 are shown. These additions to the display provide the operator with a comprehensive overview and enable a rapid reaction to undesirable developments.

Figure 6:
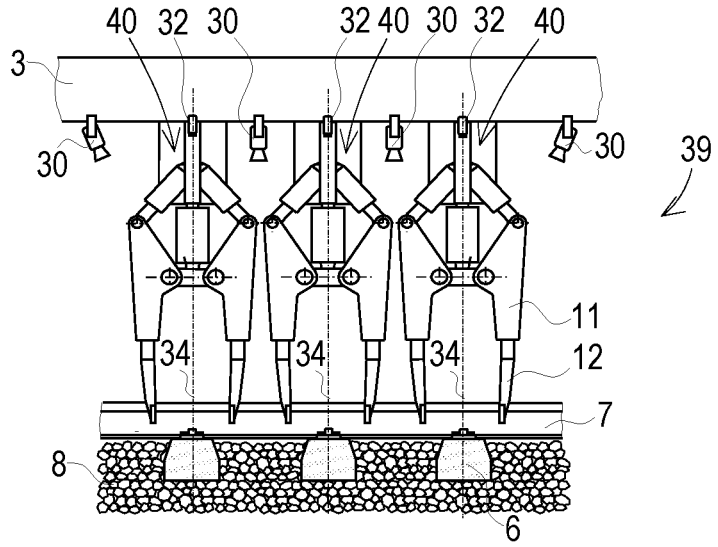

With a multi-sleeper tamping unit 39 for the simultaneous tamping of several sleepers 6, it makes sense if additional cameras 30 are arranged between the individual unit assemblies 40 (FIG. 6). In this way, additional part image sections 24, 25, 27, 28 are available for generating a merged image 29 of the track 5 located below the multi-sleeper tamping unit 39. A lighting means 32 is additionally arranged above each unit assembly 40 for marking the corresponding axis of symmetry 34.

The invention claimed is:

1. A track maintenance machine for tamping a track comprising:

a plurality of sleepers;

a ballast bed wherein said plurality of sleepers are supported in said ballast bed with rails fitted to said ballast bed;

a machine frame that is mobile on on-track undercarriages;

a tamping unit which comprises tamping tools to be lowered into the ballast bed and set to vibrate and to be squeezed together;

a plurality of camera systems for transmitting real-time images to an output means wherein said output means is arranged upstream of the tamping unit in a working direction, wherein a first camera system is arranged upstream of the tamping unit in the working direction for recording a first surface area of the track as a first image section, and a second camera system is arranged downstream from the tamping unit in the working direction for recording a second surface area of the track as a second image section, wherein the plurality of camera systems are aligned wherein the recorded first and second image sections partly overlap, and wherein, the output means is equipped for providing the image sections in a merged image.

2. The track maintenance machine according to claim 1, wherein the tamping unit is arranged for displacement relative to the plurality of camera systems by means of displacement drives and wherein, the output means is equipped for displaying a current position of the tamping unit.

3. The track maintenance machine according to claim 1, wherein the plurality of camera systems have diagonally downwards aligned camera axes and wherein, a computer unit is set up for rectifying a distortion of recorded first and second image sections.

4. The track maintenance machine according to claim 1, wherein each camera system comprises at least two cameras comprising a first camera and a second camera with said first camera arranged next to said second camera in a transverse machine direction for recording part image sections, wherein, the part image sections of the two cameras overlap, and wherein, the output means is equipped for merging all part image sections.

5. The track maintenance machine according to claim 1, wherein a lighting means with downwardly directed light beams for generating a light marking, in the form of a lighting pattern, is arranged in recorded surface areas of the track.

6. The track maintenance machine according to claim 1, wherein the plurality of camera systems are equipped for recording infrared light and wherein, at least one infrared light source is arranged for lighting surface areas of the track to be recorded.

7. The track maintenance machine according to claim 1, wherein a sensor means for recording sleeper positions is arranged upstream of the first camera system in the working direction, and wherein, the output means is coupled with the sensor means for displaying the recorded sleeper positions in the merged image.

8. The track maintenance machine according to claim 1, wherein at least one camera is arranged laterally next to the tamping unit for recording a vertical position of the tamping tools.

9. A method for operating a track maintenance machine according to claim 1, wherein the merged image is displayed to an operator in real time with the aid of the output means and wherein, the tamping unit is positioned relative to the track using the merged image.

10. The method according to claim 9, wherein a current position of the tamping unit is recorded as a recording and wherein penetration points of the tamping tools resulting from said recording are displayed in the merged image.

11. The method according to claim 9, wherein a light marking is generated on the recorded surface areas of the track with the aid of a lighting means.

12. The method according to claim 11, wherein a lighting pattern is generated with the aid of the lighting means and wherein, the first and second image sections are merged by matching the lighting pattern.

13. The method according to claim 9, wherein a three-dimensional illustration of the recorded surface areas of the track is calculated from recorded image data of the plurality of camera systems.

14. The method according to claim 9, wherein sleeper positions are recorded with the aid of a sensor means during a forward movement of the track maintenance machine and wherein, the sleeper positions are displayed to the operator in the merged image.

15. The method according to claim 9, wherein a set of tamping positions are stipulated by means of an assistance system and wherein, suggested tamping positions are displayed to the operator in the merged image.

* * * * *